United States Patent [19]

Morash

[11] 3,970,206

[45] July 20, 1976

[54] STACKABLE FEEDING ASSEMBLIES

[76] Inventor: Paule Gisele Morash, 17, Avenue La Bruyere, 78 Marly-le-Roi, France

[22] Filed: Aug. 19, 1974

[21] Appl. No.: 498,661

Related U.S. Application Data

[63] Continuation of Ser. No. 239,043, Feb. 29, 1972, abandoned.

[30] Foreign Application Priority Data

Apr. 19, 1971 France ..... 71.13672

[52] U.S. Cl. ..... 215/11 R; 206/503

[51] Int. Cl.[2] ..... A61J 9/00

[58] Field of Search ..... 215/10, 11 R; 206/503, 206/579; 220/4 B

[56] References Cited

UNITED STATES PATENTS

| | | | |
|---|---|---|---|
| 701,070 | 5/1902 | Minwegen | 215/11 R |
| 2,338,397 | 1/1944 | Beasley | 220/4 B |
| 3,292,811 | 12/1966 | Lynch | 220/4 B |
| 3,609,263 | 9/1971 | Clementi | 206/519 |
| 3,623,634 | 11/1971 | Norgard | 150/.5 |
| 3,642,165 | 2/1972 | VonDerOsten | 206/503 |
| 3,800,843 | 4/1974 | Edwards | 215/10 |

*Primary Examiner*—Ro E. Hart

*Attorney, Agent, or Firm*—Craig & Antonelli

[57] ABSTRACT a. The present invention is directed to feeding devices for nursing infants; such as feeding bottles.

b. The feeding assembly of the present invention is of the type comprising a container, a teat and means for fixing the teat on the container, which is distinguished in that a number of containers and/or bottoms thereof and/or pre-pierced or slit teats, and the means for fixing the teats on the containers, are stacked one upon the other, the stacking of the containers and/or bottoms and/or pre-pierced or slit teats and fixing means being such that the removal from the stack of a container and/or a teat and a fixing means does not reduce the sterile condition of those remaining in the stack.

c. Thus, feeding devices and feeding bottles of the type comprising a container, a teat and means for fixing the teat on the container are provided.

28 Claims, 6 Drawing Figures

STACKABLE FEEDING ASSEMBLIES

This is a continuation of application Ser. No. 239,043, filed Feb. 29, 1972, now abandoned.

This invention relates to single-use feeding assemblies which are preferably pre-sterilised.

Known feeding assemblies generally comprise a container, a teat and means for fixing the teat to the bottle. The container and the means for fixing the teat to the container are intended to be used over long periods which can be as long as the whole of the nursing feeding period; only the teat is thrown away after it has been used several times. The container, the teat and the fixing means of the known assemblies must be sterilised each time before the assembly is used. This is tiresome and involves a waste of time; finally, it is very difficult, if not impossible, to carry out the sterilisation operation when travelling; in that case, the only solution is to carry a number of pre-prepared complete bottles. In addition, as the container of the known assembly is to be used throughout the nursing feeding period, the volume of the container does not correspond to the amount of milk (or pap) to be given at each feed, but corresponds to the maximum amount of the last feed period.

The feeding assemblies according to the invention make it possible to overcome these disadvantages. In fact, the feeding assemblies according to the invention make it possible to transport or store, in a sterile manner, a certain number of containers, teats and means for fixing teats on the containers; these containers are also of a volume which corresponds to the amount of milk (or pap) for the feed period in question. After an assembly comprising container, teat and fixing means has been used, the used assembly is thrown away, the other assemblies of containers, teats and fixing means remaining sterile and ready for the preparation of the feed.

The feeding assemblies according to the invention comprise, stacked one upon the other, a number of containers and/or the bottoms thereof and/or teats and means for fixing the teats on the containers, all these being sterilised; the stacking of the containers and/or teats and fixing means being such that removal from the stack of a container and/or teat and fixing means does not impair the sterility of those remaining in the stack. In accordance with one embodiment, the containers on one hand and the teats and fixing means on the other hand comprise two different stacks. The containers are then disposed in a pile, each container having its bottom disposed sealingly in the preceding container. Likewise, the teats and the fixing means are stacked in a sealed manner, each teat acting as a receptacle for the following teat. Each pile is sealed by means of a cover which can easily be removed.

In accordance with another embodiment, the assembly of the container, without its bottom but with the teat fixed in position, is stacked sealingly on the adjacent assembly; this time it is each assembly which acts as a sealed receptacle for the following assembly. The last assembly is closed by a number of container bottoms which are stacked one on the other, the first of the bottoms sealingly closing the last container-and-teat assembly, the number of bottoms obviously being equal to the number of assemblies.

The accompanying drawings illustrate by way of example embodiments of the feeding assemblies according to the present invention:

Figure 3:
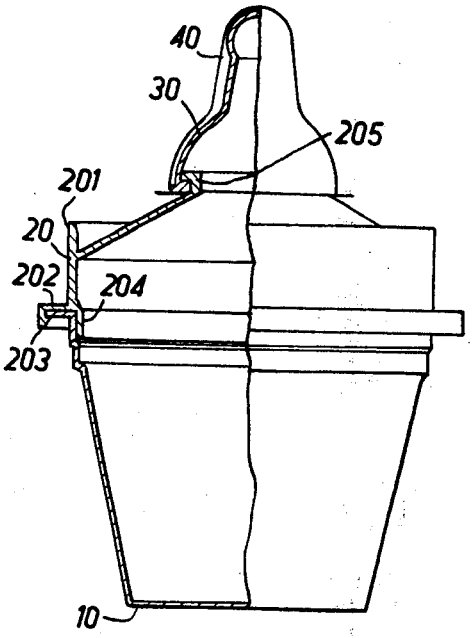
FIG. 3 shows a cross-sectional view of an assembled feeding assembly in accordance with the first embodiment.

A feeding assembly as shown in FIG. 3 comprises a container 10 which is in the general shape of a cup, a teat 30 and means for fixing the teat on the container, which means is here in this embodiment in the form of an intermediate member which has the general shape of a cover 20. It is also provided with a teat protective cover 40.

Figure 2:
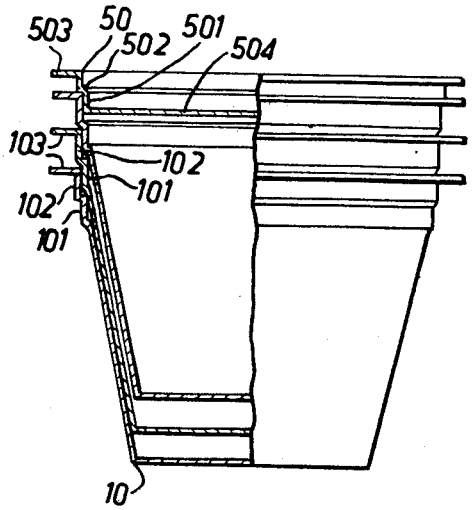
FIG. 2 shows a cross-sectional view of a stack of containers in accordance with the first embodiment.

In accordance with the invention, the containers or cups 10 are of a shape which permits them to be stacked sealingly one upon the other. In the embodiment illustrated, the lateral flared wall of the cup 10 has in its upper part two vertical offset portions 101 and 102, and a flange 103. It is the portion 101 of the upper cup which engages into the portion 102 of the lower cup, the two cups being sealed by suitable dimensioning of the portions 101 and 102. The mode of interengagement of the cups is given only by way of example. Other embodiments, for example with a screw thread or with a bayonet-type closure, can be envisaged without thereby departing from the scope of the invention. The pile of cups 10 is closed at its upper part by a cap 50 which engages sealingly by means of offset portions 501 and 502 into the corresponding part of the uppermost cup in the stack. The bottom 504 protects the last cup (FIG. 2).

Figure 1:
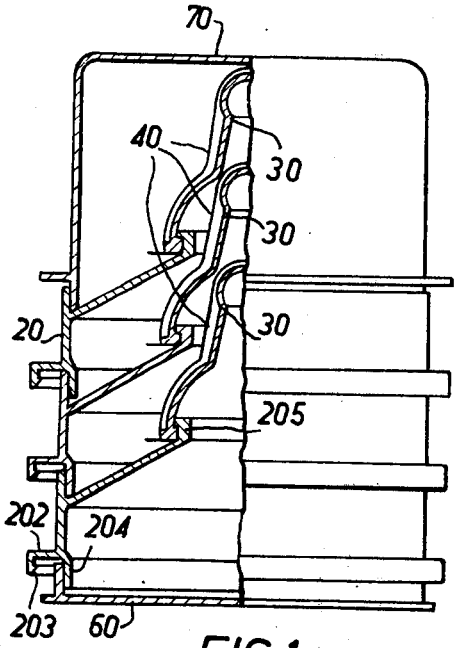
FIG. 1 shows a cross-sectional view of a pile of teats and in accordance with a first embodiment.

Similarly, the intermediate fixing members on covers 20 which carry teats 30 fixed at 205, for example by engagement on their upper open part, are of a configuration which permits them to engage one into the other by means of projections 201 and an inverted annular groove 202 and 204 which co-operates with said projection in the position in which the teat carriers are engaged (FIG. 1). When the teat and its cover are assembled with the cup 10, the inverted annular groove 202 and 204 co-operates with the flange 103 of the cup and seals the feeding assembly, by clamping the flange 103 by the enlarged portion 203 (FIG. 3).

As for the containers, other modes of assembly can be provided.

The teats are slit or pierced and are protected by removable caps 40. The cap 40 is not necessarily hermetic and sealing.

To ensure the sealing and sterility of the assembly, the pile of teats is sealingly closed by a cap 70 and a cover 60 which are engaged (or screwed) in position according to the system employed for the covers.

Operation is as follows:

The piles of cups and teats are supplied to the user in a sterilised and sealed condition.

To give a feed, a cup 10 is removed from the pile on the side which does not carry the cap 50, and is filled with the feeding preparation. The volume of the cup 10 preferably corresponds each time to the amount of feeding preparation to be given to the nursing infant. Thus there are cups which are of increasing volume, to take account of the growth of the infant, cups of a given volume being for example fitted together in a stack. Then, the protective cap 70 is removed from the upper part of the stack of teats 30 and covers 40. The top cover which carries a teat just below is removed, and the full cap is capped with the cover. The cap 70 is then replaced on the stack of teats. After the full and assembled assembly has been heated, the protective cap 40 has only to be removed from the teat, to give the feed.

The corresponding number of cups and teats can be any number whatever, but it is preferably equal to the number of bottles to be given per day.

The cups, caps and covers can be of any suitable material, for example glass, synthetic material, treated paper, etc.

Figure 4:
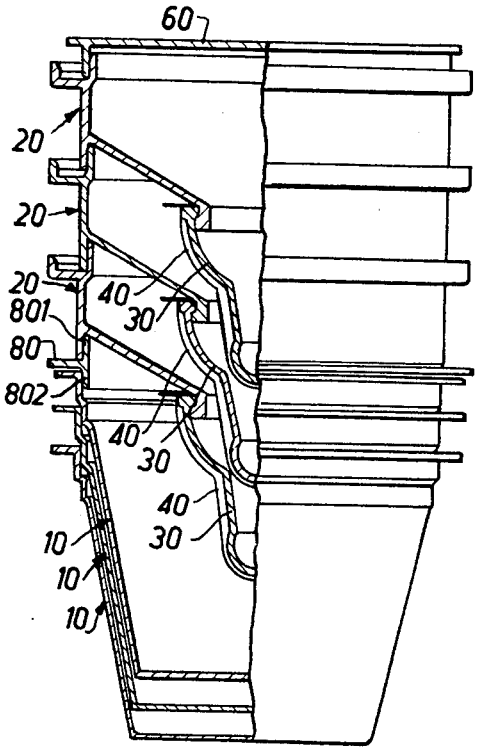
FIG. 4 shows the pile of containers and the pile of teats and fixing means, put together in the form of a single pile.

If the assembly of cups and caps with teats is to be presented, as shown in FIGS. 1 to 3, in the form of a single stack, the caps 50 and 60 are omitted and the last teat-carrying cover is fitted directly on the first cup; alternatively (FIG. 4), the cap 70 is replaced by an annular member 80 having two projections 801 and 802 which project upwardly and downwardly respectively; this member makes it possible for the first cover to be fitted onto the first cup, the teat then being turned towards the interior of the cup. In this case, to give the feed, the last teat (the first on top in FIG. 4) is removed, after the cover 60 has been removed (the cover 60 is then replaced on the following cap).

Figure 5:
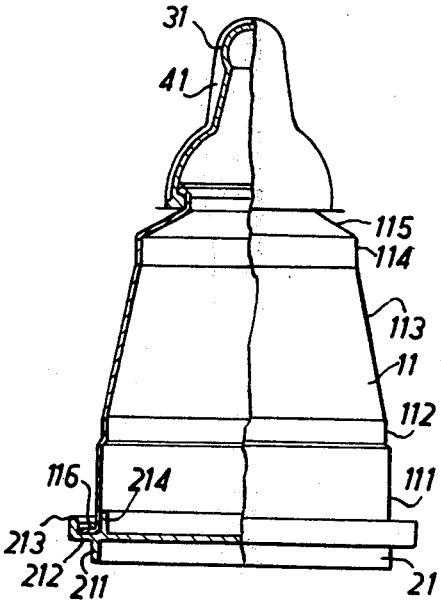
FIG. 5 shows a feeding assembly, in accordance with another embodiment.
Figure 6:
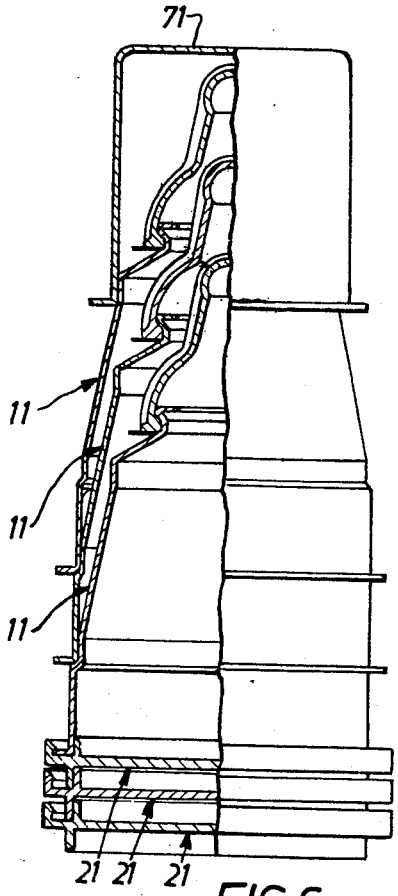
FIG. 6 shows a cross-sectional view of the containers and the bottoms thereof, the teats and fixing means, put together in the form of a single pile, in accordance with said other embodiment.

In another embodiment, as shown in FIGS. 5 and 6, the container 11 and the teat 31 are supplied in an assembled condition, the teat in this case also being protected by a cap 41 which is not necessarily a sealing cap, and the container 11 is provided without its bottom in this assembled condition. The container 11 in this embodiment serves as the intermediate fixing member. The cup 11 comprises, moving upwardly:

a first straight portion 111, a second straight portion 112 whose diameter is slightly less than the portion 111, a frustoconical portion 113, a straight portion 114, and another frustoconical portion 115 on which the teat is carried.

The straight portions 111 and 112 are so dimensioned that the internal wall of the portion 111 co-operates with the external wall of the portion 112, to ensure that the containers 11 are sealingly fitted one upon the other. The portion 111 also comprises a flange 116 which co-operates with a groove 212 and 213 in a stopper 21 for sealing the lower part of the stack (or the lower part of the container 11). For that purpose, an enlarged portion 213 serves to lock the flange 116 in the groove 212 and 213.

The stopper 21 also comprises a projection 211 which permits the other stoppers 21 to be stacked one below the other, as shown in FIG. 6. The straight portion 114 is provided for sealingly engaging with the internal wall of a protective cap 71 in the form of a cup. The assembly is thus sterilised.

The modes of stacking and of the bottle by engagement are illustrated only by way of example. Other modes, such as screwing or bayonet fixing, can be used without thereby departing from the scope of the invention.

When a feed is to be given, the container carrying the cap 71 is removed from the remainder of the pile, and filled with the feeding preparation. It is preferable that the teat should be split at its end rather than pierced, so as to prevent the liquid flowing out during preparation of the feed. The stopper 21 at the other end of the pile is removed and the full container is then closed. It is then separated from the cup 71 which is replaced on the following container. After heating, the protective cap 41 has only to be removed from the teat 31 to give the feed.

Many improvements and modifications can be made without thereby departing from the scope of the invention.

I claim:

1. A stackable arrangement for constructing a sterile single-use nursing bottle of the type having a container, a teat and a connecting means for fixing the teat to the container, said arrangement comprising:

a first plurality of first sub-assemblies arranged in stacked relationship, each of said first sub-assemblies including one of a container for a nursing bottle and a bottom stopper means, and a second plurality of second sub-assemblies arranged in stacked relationship, each of said second sub-assemblies including one of a teat fixed to a connecting means and a teat fixed to a container of a nursing bottle, wherein a sterile nursing bottle is constructed from one of a container of said first sub-assembly fixed to a teat and connecting means of said second sub-assembly and a bottom stopper means of said first sub-assembly fixed to a teat and container of said second sub-assembly.

2. A stackable arrangement according to claim 1, wherein said first and second plurality are fixed together in a single sterile stack.

3. A stackable arrangement according to claim 1, wherein said first and second plurality are separated from one another in separate sterile stacks.

4. An assembly for providing a sterile single-use nursing bottle of the type having a container, a teat and connecting means for fixing the teat to the container, said assembly comprising:

a first plurality of first sub-assemblies arranged in stacked relationship, each of said first sub-assemblies including a container for a nursing bottle, and a second plurality of second sub-assemblies arranged in stacked relationship, each of said second sub-assemblies including a teat and connecting means, said connecting means being adapted to fix said teat to a respective container, each of said first and second sub-assemblies being constituent members of the nursing bottle such that one said container of said first sub-assembly fixed to one second sub-assembly of said teat and connecting means forms a sterile nursing bottle, wherein said first and second plurality are fixed together in a single sterile stack.

5. An assembly according to claim 4, wherein said container of each said first sub-assembly includes a cylindrical member having a closed end and an open end, said open end including an offset portion and a flared flange extending outwardly from said offset portion.

6. An assembly according to claim 5, wherein said closed end of said container of each said first sub-assembly is inserted into the open end of a next respective first sub-assembly to form said first plurality.

7. An assembly according to claim 6, wherein the teat of each said second sub-assembly is inserted within a next respective second sub-assembly to form said second plurality.

8. An assembly according to claim 7, wherein the teat of the outermost second sub-assembly of said second plurality is inserted into the open end of the outermost container of said first plurality of first sub-assemblies such that the first and second pluralities are fixed together.

9. An assembly according to claim 8, wherein the single stack of said first and second plurality includes a cover means for covering the end of said second plurality remote from said first plurality.

10. An assembly according to claim 4, wherein each of said second sub-assemblies includes a protective teat cover for sterilely covering said teat.

11. An assembly for providing a sterile single-use nursing bottle of the type having a container, a teat and connecting means for fixing the teat to the container, said assembly comprising:

a first plurality of first sub-assemblies arranged in a stacked relationship, each of said first sub-assemblies including a bottom stopper means, and a second plurality of second sub-assemblies arranged in stacked relationship, each of said second sub-assemblies including a teat and a container of a nursing bottle, said teat fixed to a first end of said container, and said container having a second open end, each of said first and second sub-assemblies being constituent members of the nursing bottle such that one bottom stopper means of a first sub-assembly fixed to said second open end of said container of one second sub-assembly forms a sterile nursing bottle, wherein said first and second plurality are fixed together in a single sterile stack.

12. An assembly according to claim 11, wherein the second open end of said container of one second sub-assembly is adapted to be inserted over the teat and first end of said container of the next respective second sub-assembly to form said second plurality.

13. An assembly according to claim 12, wherein the teat of each said second sub-assembly is inserted within a next respective second sub-assembly to form said second plurality.

14. An assembly according to claim 13, wherein the second open end of the container of the innermost second sub-assembly of said second plurality is fixed to the bottom stopper means of the innermost first sub-assembly of said first plurality such that the first and second plurality are fixed together in said single stack.

15. An assembly according to claim 14, wherein the outermost ends of said single stack include respective cover means.

16. An assembly according to claim 11, wherein a cap means is provided for covering said teat of each said second sub-assembly.

17. A preassembly for providing a sterile single-use nursing bottle of the type having a container, a teat and connecting means for fixing the teat to the container, said preassembly comprising:

a first plurality of first sub-assemblies arranged in stacked relationship, each of said first sub-assemblies including a container for a nursing bottle, and a second plurality of second sub-assemblies arranged in stacked relationship, each of said second sub-assemblies including a teat and connecting means, said connecting means being adapted to fix said teat to a respective container, each of said first and second sub-assemblies being constituent members of the nursing bottle such that one said container of said first sub-assembly fixed to one teat and connecting means of said second sub-assembly forms a sterile nursing bottle, wherein said first and second plurality are separate from one another to form said preassembly.

18. A preassembly according to claim 17, wherein said first sub-assemblies are sealingly stacked in said first plurality to be in sterile relationship.

19. A preassembly according to claim 18, wherein said container of each said first sub-assembly includes a cylindrical member having a closed end and an open end, said open end including an offset portion and a flared flange extending outwardly from said offset portion.

20. A preassembly according to claim 19, wherein said closed end of said container of each said first sub-assembly is inserted into the open end of a next respective first sub-assembly to form said first plurality.

21. A preassembly according to claim 20, wherein said first plurality includes a first cover means for sealingly covering the open end of the container forming the outermost one of the stacked first plurality of first sub-assemblies.

22. A preassembly according to claim 17, wherein said second sub-assemblies are sealingly stacked in said second plurality to be in sterile relationship.

23. A preassembly according to claim 22, wherein said teat is connected to said connecting means in each of said second sub-assemblies.

24. A preassembly according to claim 23, wherein said connecting means includes a projection means and an inverted annular groove for forming a connection between respective ones of said second sub-assemblies, said projection means and inverted annular groove providing means for fixing said teat to said container.

25. A preassembly according to claim 24, wherein the teat of each said second sub-assembly is inserted within a next respective second sub-assembly to form said second plurality.

26. A preassembly according to claim 25, wherein the outermost ones of said second plurality of second sub-assemblies are covered by respective second and third cover means.

27. A preassembly according to claim 17, wherein said first and second sub-assemblies are each mounted in said respective first and second plurality by at least one of a frictional engagement, a screw thread and a bayonet connection.

28. A preassembly according to claim 17, wherein a cap means is provided for covering said teat of each said second sub-assembly.

* * * * *